US009351587B2

(12) United States Patent
Burns et al.

(10) Patent No.: US 9,351,587 B2
(45) Date of Patent: May 31, 2016

(54) CHILD SUPPORT UNIT FOR A PLAY YARD

(71) Applicant: KIDS II, INC., Atlanta, GA (US)

(72) Inventors: Stephen R. Burns, Cumming, GA (US); Chaitanya Tadipatri, Alpharetta, GA (US)

(73) Assignee: KIDS II, INC., Atlanta, GA (US)

( * ) Notice: Subject to any disclaimer, the term of this patent is extended or adjusted under 35 U.S.C. 154(b) by 0 days.

(21) Appl. No.: 14/743,661

(22) Filed: Jun. 18, 2015

(65) Prior Publication Data

US 2015/0282640 A1 Oct. 8, 2015

Related U.S. Application Data

(63) Continuation of application No. 14/088,985, filed on Nov. 25, 2013.

(60) Provisional application No. 61/731,251, filed on Nov. 29, 2012, provisional application No. 61/827,051, filed on May 24, 2013, provisional application No. 61/831,862, filed on Jun. 6, 2013.

(51) Int. Cl.

| | |
|---|---|
| ***A47D 7/00*** | (2006.01) |
| ***A47D 13/06*** | (2006.01) |
| ***A47D 7/04*** | (2006.01) |
| ***A47D 5/00*** | (2006.01) |
| ***A47D 9/00*** | (2006.01) |

(52) U.S. Cl.

CPC *A47D 13/06* (2013.01); *A47D 5/00* (2013.01); *A47D 7/04* (2013.01); *A47D 9/00* (2013.01); *A47D 13/061* (2013.01); *A47D 13/063* (2013.01)

(58) Field of Classification Search

CPC ..... A47D 7/00
USPC ..... 5/93.1, 98.1, 93.2, 99.1, 102
See application file for complete search history.

(56) References Cited

U.S. PATENT DOCUMENTS

| | | | |
|---|---|---|---|
| 1,288,347 | A | 12/1918 | Wilson |
| 1,391,650 | A | 9/1921 | Truesdell et al. |
| 1,427,598 | A | 8/1922 | Jackson |
| 1,493,505 | A | 5/1924 | Smith |
| 1,512,522 | A | 10/1924 | Colburn |
| 1,545,446 | A | 7/1925 | Paulet |
| 1,658,944 | A | 2/1928 | Schaeffer |
| 1,724,479 | A | 8/1929 | Havener |
| 1,794,561 | A | 3/1931 | Taylor |
| 1,812,971 | A | 7/1931 | McCandless |
| 1,827,687 | A | 10/1931 | McCandless |
| 2,280,913 | A | 4/1942 | Hummel et al. |
| 2,595,532 | A | 5/1952 | Leitner |

(Continued)

FOREIGN PATENT DOCUMENTS

| | | |
|---|---|---|
| DE | 2856168 A1 | 7/1980 |
| DE | 8705939 U1 | 9/1987 |

(Continued)

*Primary Examiner* — Frederick Conley
(74) *Attorney, Agent, or Firm* — Gardner Groff Greenwald & Villanueva, PC

(57) ABSTRACT

A play yard system for infants or small children. They play yard includes a frame, and the system includes at least one child support unit for mounting to the frame of the play yard. The at least one child support unit may take the form of a bassinet and/or a changing table. The play yard frame may be collapsible for storage and transport, and the child support unit may be removable from the play yard frame.

17 Claims, 6 Drawing Sheets

(56) References Cited

U.S. PATENT DOCUMENTS

| | | | | |
|---|---|---|---|---|
| 2,614,264 | A | 10/1952 | Schmidt, Jr. | |
| 2,752,614 | A | 7/1956 | Hayward | |
| 2,831,199 | A | 4/1958 | Stanley | |
| 3,135,970 | A | 6/1964 | Trent et al. | |
| 3,427,666 | A | 2/1969 | Saxe | |
| 3,644,947 | A | 2/1972 | Padera | |
| 4,967,432 | A | 11/1990 | Kujawski et al. | |
| 5,092,001 | A | 3/1992 | Ross et al. | |
| 5,163,191 | A | 11/1992 | Chan | |
| 5,339,470 | A | 8/1994 | Shamie | |
| 5,349,709 | A | 9/1994 | Cheng | |
| 5,446,934 | A | 9/1995 | Frazier | |
| 5,697,111 | A | 12/1997 | Dillner et al. | |
| 5,778,465 | A | 7/1998 | Myers | |
| 5,819,342 | A | 10/1998 | Williams | |
| 5,826,285 | A | 10/1998 | Mariol et al. | |
| 5,845,349 | A | 12/1998 | Tharalson et al. | |
| 5,845,666 | A | 12/1998 | Messner | |
| 5,867,850 | A | 2/1999 | Mariol | |
| 5,867,851 | A | 2/1999 | Mariol et al. | |
| 5,918,329 | A | 7/1999 | Huang | |
| 5,991,944 | A | 11/1999 | Yang | |
| 6,058,528 | A | 5/2000 | Yang | |
| 6,182,308 | B1 | 2/2001 | Yang | |
| 6,192,535 | B1 | 2/2001 | Warner, Jr. et al. | |
| 6,418,575 | B1 | 7/2002 | Cheng | |
| 6,470,515 | B1 | 10/2002 | Hsia | |
| 6,526,608 | B1 | 3/2003 | Hsia | |
| 6,539,563 | B1 | 4/2003 | Hsia | |
| 6,543,070 | B2 | 4/2003 | Longenecker et al. | |
| 6,735,796 | B2 | 5/2004 | Warner, Jr. et al. | |
| 6,877,173 | B2 | 4/2005 | Tharalson et al. | |
| 6,948,197 | B1 | 9/2005 | Chen | |
| 6,952,849 | B2 | 10/2005 | Pacella | |
| 7,003,823 | B1 | 2/2006 | Reed et al. | |
| 7,111,339 | B2 | 9/2006 | Chen | |
| 7,228,575 | B2 | 6/2007 | Chen | |
| 7,263,729 | B2 | 9/2007 | Paesang et al. | |
| 7,346,943 | B2 | 3/2008 | Chen | |
| 7,376,993 | B2 | 5/2008 | Myers et al. | |
| 7,415,739 | B2 | 8/2008 | Tharalson et al. | |
| 7,418,745 | B2 * | 9/2008 | Paesang et al. | 5/98.1 |
| 7,458,114 | B2 | 12/2008 | Troutman | |
| 7,509,694 | B2 | 3/2009 | Chen | |
| 7,568,242 | B2 | 8/2009 | Troutman | |
| 7,581,269 | B2 | 9/2009 | Chen et al. | |
| 7,739,759 | B2 | 6/2010 | Mendes et al. | |
| 7,818,832 | B2 | 10/2010 | Hartenstine et al. | |
| 7,882,579 | B2 | 2/2011 | Jackson et al. | |
| 7,908,686 | B2 | 3/2011 | Clapper et al. | |
| 7,937,790 | B2 | 5/2011 | Zhao et al. | |
| 7,950,081 | B2 | 5/2011 | Chen et al. | |
| 7,958,578 | B2 | 6/2011 | Shan et al. | |
| 8,001,630 | B2 | 8/2011 | Burkholder et al. | |
| 8,011,036 | B2 | 9/2011 | Tuckey | |
| 8,028,358 | B2 | 10/2011 | Fiore, Jr. | |
| 8,141,186 | B2 | 3/2012 | Burns et al. | |
| 8,201,291 | B2 | 6/2012 | Burns et al. | |
| 8,230,536 | B2 | 7/2012 | Clapper et al. | |
| 8,257,229 | B2 | 9/2012 | Myers et al. | |
| 8,281,431 | B2 | 10/2012 | Hartenstine | |
| 8,291,530 | B2 | 10/2012 | Burkholder et al. | |
| 8,307,475 | B2 | 11/2012 | Hutchinson et al. | |
| 8,316,481 | B2 | 11/2012 | Arnold, IV et al. | |
| 8,316,483 | B2 | 11/2012 | Thomas et al. | |
| 8,321,973 | B2 | 12/2012 | Bickley | |
| 8,387,807 | B2 | 3/2013 | Chen et al. | |
| 8,424,131 | B2 | 4/2013 | Thomsen et al. | |
| 8,491,215 | B2 | 7/2013 | Young | |
| 8,522,374 | B2 | 9/2013 | Sousa et al. | |
| 8,528,130 | B2 | 9/2013 | Bu et al. | |
| 8,544,125 | B2 | 10/2013 | Greger et al. | |
| 8,555,434 | B2 | 10/2013 | Chapman et al. | |
| 8,566,988 | B2 | 10/2013 | Son et al. | |
| 8,677,533 | B2 | 3/2014 | Barron et al. | |
| 8,764,612 | B2 | 7/2014 | Myers et al. | |
| 8,806,673 | B2 | 8/2014 | Burkholder et al. | |
| 8,893,325 | B2 | 11/2014 | Arnold, IV et al. | |
| 8,925,128 | B2 | 1/2015 | Fiore, Jr. et al. | |
| 9,066,607 | B1 | 6/2015 | Ransil et al. | |
| 9,078,530 | B2 | 7/2015 | Ingram et al. | |
| 9,089,225 | B2 | 7/2015 | Fiore, III et al. | |
| 9,101,226 | B1 | 8/2015 | Hartenstine et al. | |
| 9,113,723 | B2 | 8/2015 | Greger et al. | |
| 9,179,786 | B1 | 11/2015 | Ransil et al. | |
| 2001/0001330 | A1 | 5/2001 | Warner, Jr. et al. | |
| 2002/0152550 | A1 * | 10/2002 | Tharalson et al. | 5/95 |
| 2003/0177575 | A1 | 9/2003 | Cheng et al. | |
| 2005/0150053 | A1 | 7/2005 | Hartenstine | |
| 2006/0000019 | A1 | 1/2006 | Martin | |
| 2006/0021138 | A1 | 2/2006 | Waldman et al. | |
| 2006/0080776 | A1 | 4/2006 | Clapper et al. | |
| 2006/0218725 | A1 | 10/2006 | Carpenter et al. | |
| 2006/0225204 | A1 | 10/2006 | Bretschger et al. | |
| 2006/0225205 | A1 * | 10/2006 | Troutman | 5/93.1 |
| 2007/0017025 | A1 | 1/2007 | Myer | |
| 2007/0204403 | A1 | 9/2007 | Hartenstine | |
| 2007/0204404 | A1 | 9/2007 | Hartenstine | |
| 2007/0271697 | A1 | 11/2007 | Martin | |
| 2009/0077741 | A1 | 3/2009 | Burns et al. | |
| 2010/0138991 | A1 | 6/2010 | Hartenstine et al. | |
| 2010/0162484 | A1 | 7/2010 | Thomas et al. | |
| 2012/0037869 | A1 | 2/2012 | Fiore, III et al. | |
| 2012/0110730 | A1 * | 5/2012 | Sousa et al. | 5/2.1 |
| 2013/0086750 | A1 | 4/2013 | Cheng | |
| 2013/0125304 | A1 | 5/2013 | DeHart et al. | |
| 2013/0198952 | A1 | 8/2013 | Rong et al. | |
| 2014/0068857 | A1 | 3/2014 | Jackson et al. | |
| 2014/0208503 | A1 | 7/2014 | Horst et al. | |
| 2014/0215713 | A1 | 8/2014 | Myers et al. | |
| 2015/0173523 | A1 | 6/2015 | Horst et al. | |
| 2015/0216321 | A1 | 8/2015 | Hartenstine et al. | |
| 2015/0282640 | A1 | 10/2015 | Burns et al. | |
| 2015/0296999 | A1 | 10/2015 | Fiore, III et al. | |

FOREIGN PATENT DOCUMENTS

| | | | |
|---|---|---|---|
| DE | 4327819 | A1 | 2/1994 |
| DE | 20000537 | U1 | 8/2000 |
| EP | 1147727 | A1 | 10/2001 |
| EP | 2359719 | A1 | 8/2011 |
| EP | 2710930 | A2 | 3/2014 |
| EP | 2868235 | | 5/2015 |
| FR | 2593369 | A1 | 7/1987 |
| GB | 2330070 | A | 4/1999 |
| WO | 2013003320 | A2 | 1/2013 |

* cited by examiner

CHILD SUPPORT UNIT FOR A PLAY YARD

CROSS-REFERENCE TO RELATED APPLICATIONS

This application is a continuation of U.S. Non-Provisional patent application Ser. No. 14/088,985 filed Nov. 25, 2013, which claims the benefit of U.S. Provisional Patent Application Ser. No. 61/731,251 filed Nov. 29, 2012, U.S. Provisional Patent Application Ser. No. 61/827,051 filed May 24, 2013 and U.S. Provisional Patent Application Ser. No. 61/831,862 filed Jun. 6, 2013, the entireties of which are hereby incorporated by reference herein.

TECHNICAL FIELD

The present invention relates generally to the field of child care accessories, and more particularly to a child support unit for a play yard and a play yard including such a child support unit.

BACKGROUND

Play yard devices are utilized to provide a safe and comfortable enclosure in which infants and small children can play and rest. It is to the provision of improvements to such devices that the present invention is primarily directed.

SUMMARY

In one example aspect, the present invention relates to a child support unit for a play yard. The play yard includes a frame, and the child support unit includes a subframe and at least one coupling for attachment of the child support unit to the frame of the play yard.

In another aspect, the invention relates to a system including a play yard and a child support unit. At least one coupling is provided between the child support unit and the play yard for mounting the child support unit to the play yard.

In still another aspect, the invention relates to a method of attachment of a child support unit to a play yard device, the method including coupling a subframe of the child support unit to the frame of the play yard.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
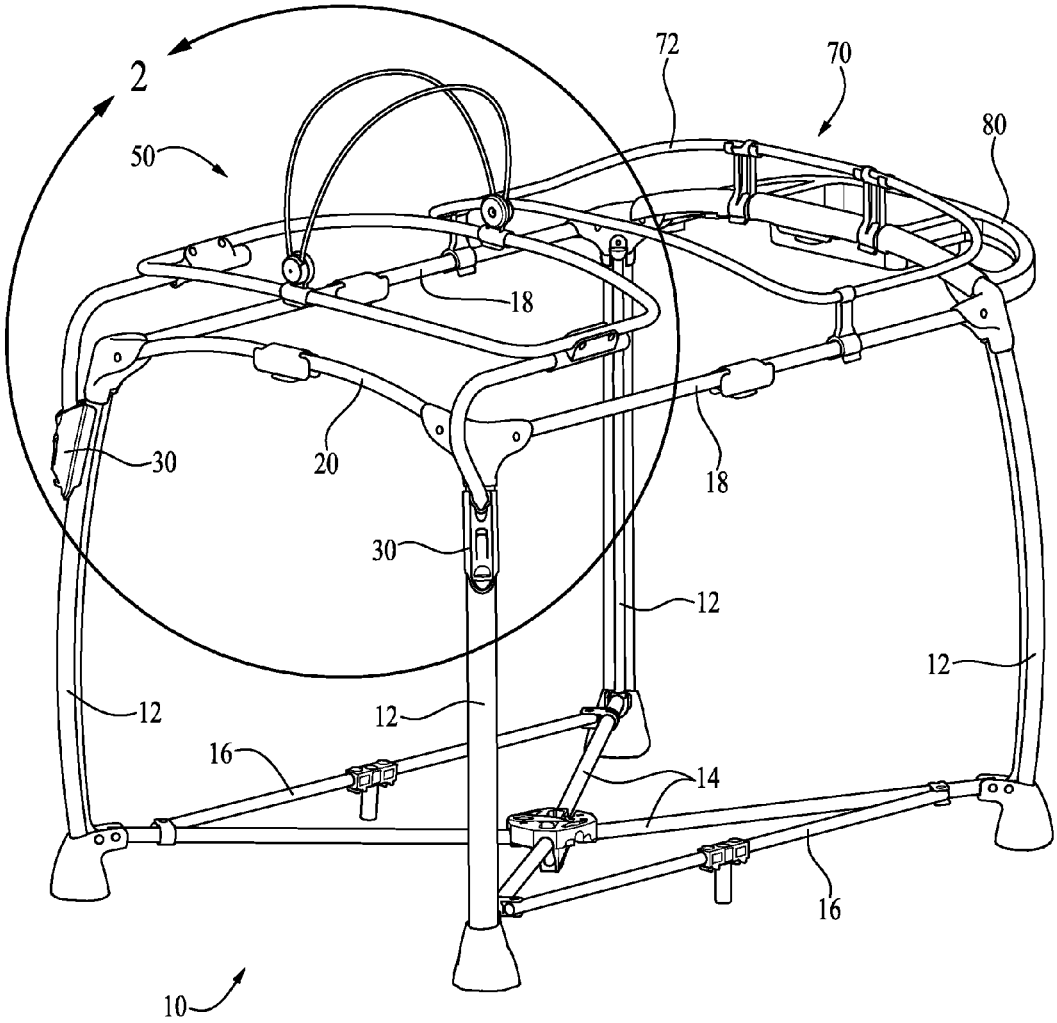
FIG. 1 is a perspective view of a play yard system having first and second child support units mounted thereto, according to an example embodiment of the present invention.
Figure 4:
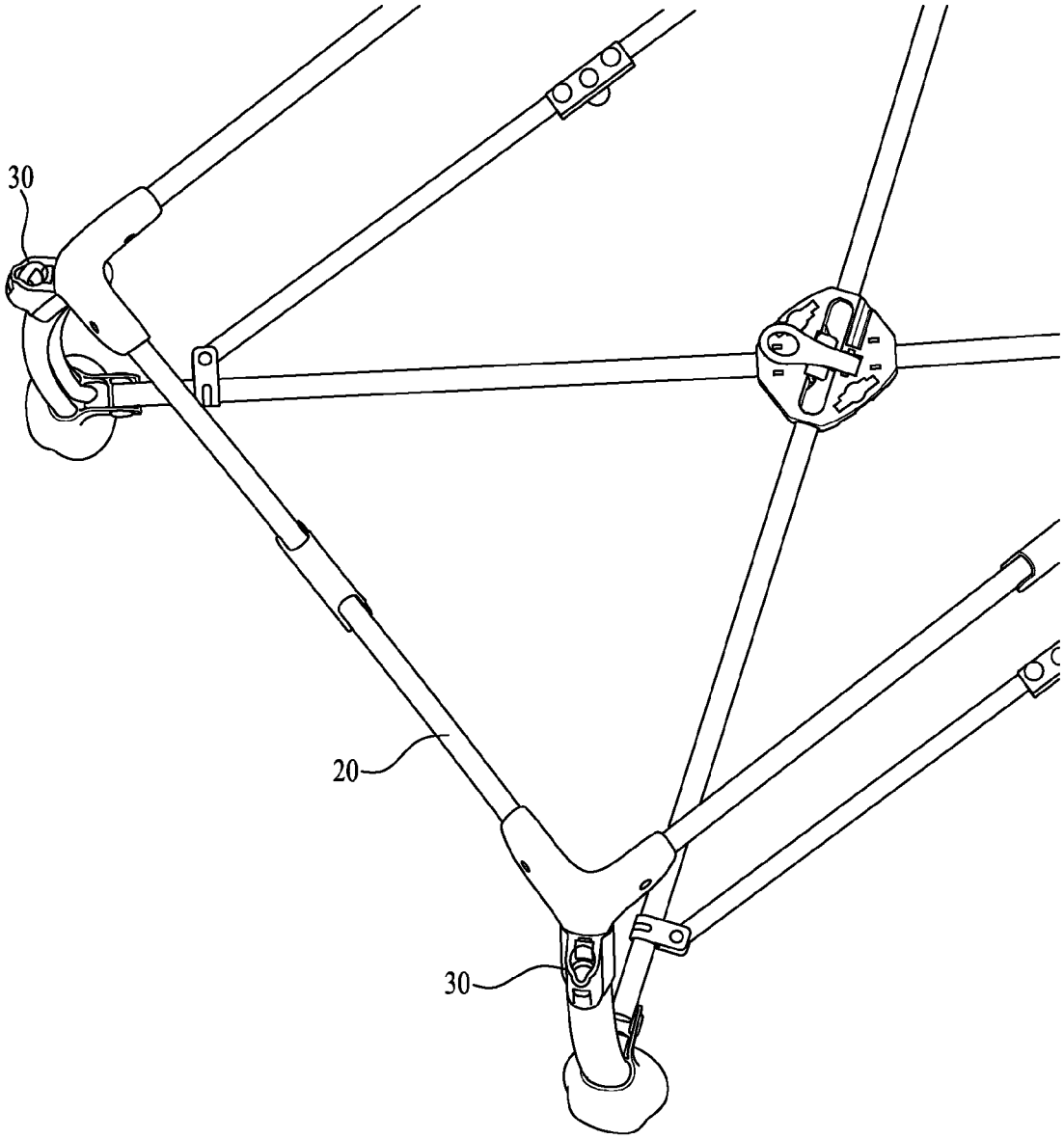
FIG. 4 is a top view showing mounting sleeves attached to the frame of the play yard device for receiving coupling members of the first child support unit to mount the child support unit to the play yard.
Figure 5:
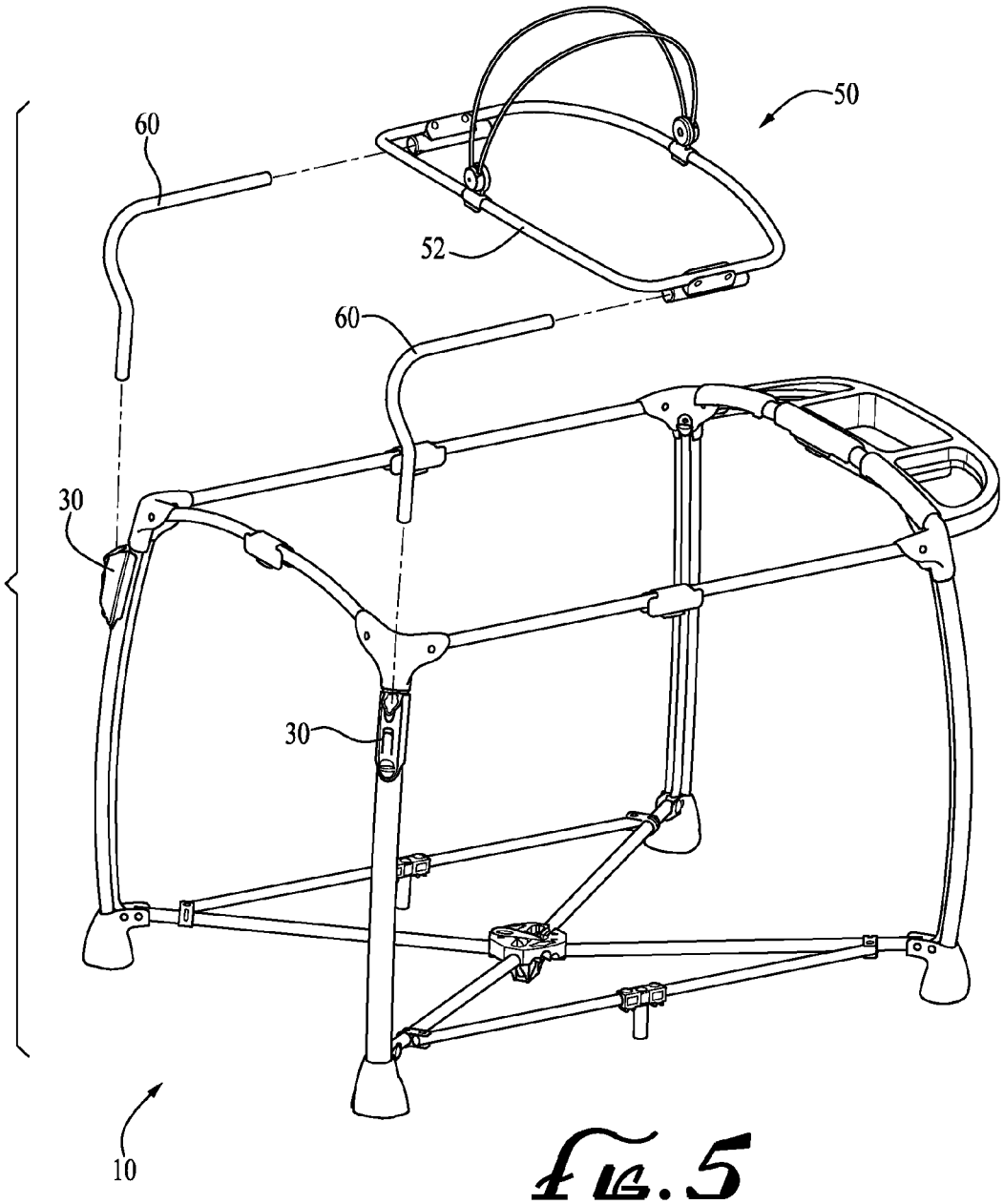
FIG. 5 is an assembly view of the play yard and the first child support unit.
Figure 6:
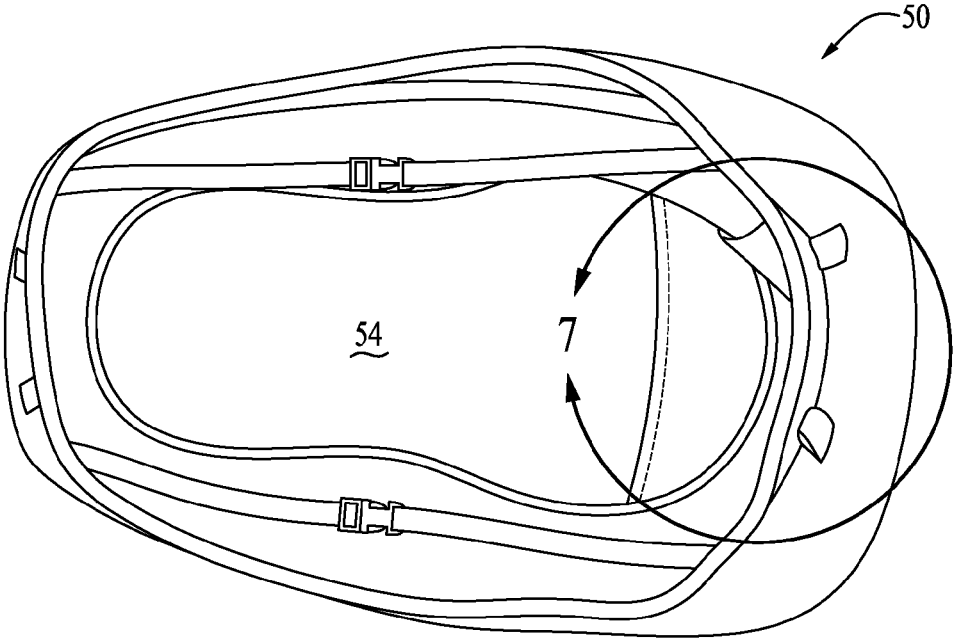
FIGS. 6-8 show further details of the child support unit, according to an example form of the invention.
Figure 7:
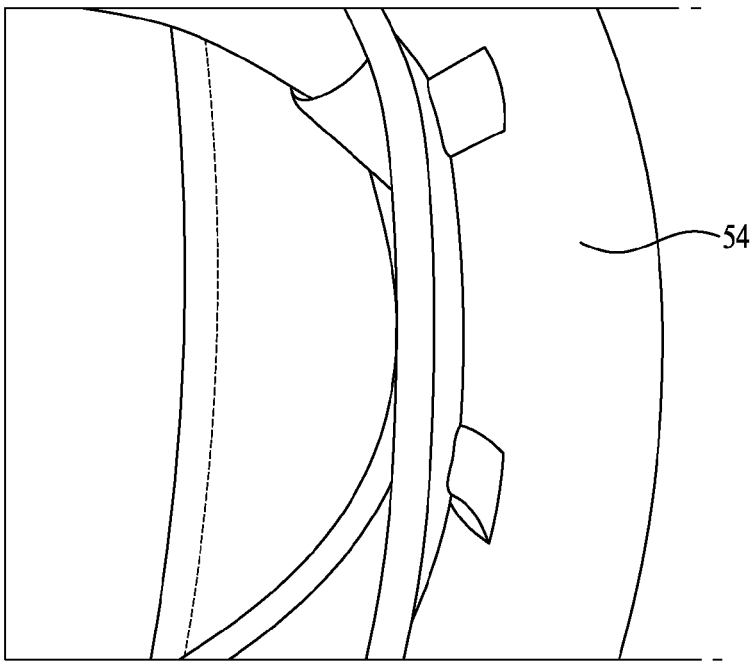

With reference now to the drawing figures, wherein like reference numbers represent corresponding parts throughout the several views, FIGS. 1, 4 and 5 show a play yard system 10 comprising a foldable frame having four corner posts 12, lower cross-bracing 14, lower siderails 16, upper siderails 18, and upper endrails 20. First and second mounting sleeves 30 are attached to the frame, for example along upper portions of the corner posts 12.

FIGS. 2, 3, and 6-8 show a first child support unit 50 configured for attachment to the frame of the play yard at a first location. In the depicted embodiment, the first child support unit 50 comprises a bassinet or cradle-like enclosure for receiving an infant or small child. The first child support unit 50 includes a subframe 52 comprising a generally rectangular periphery, soft-goods 54 such as fabric and padding installed onto the subframe forming a sling, bassinet or cradle for supporting a child placed in or on the support unit, and optionally a canopy 56 for covering at least a portion of the upper opening of the bassinet.

Figure 2:
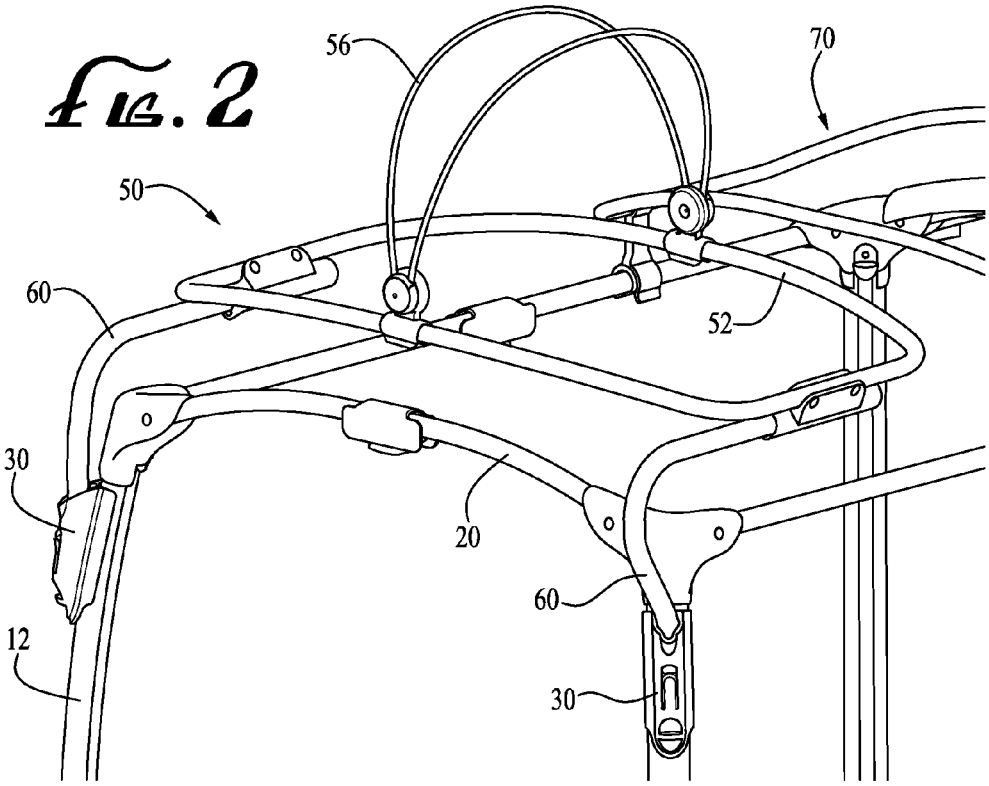
FIG. 2 is a perspective view showing greater detail of the support and mounting frame of the first child support unit.
Figure 3:
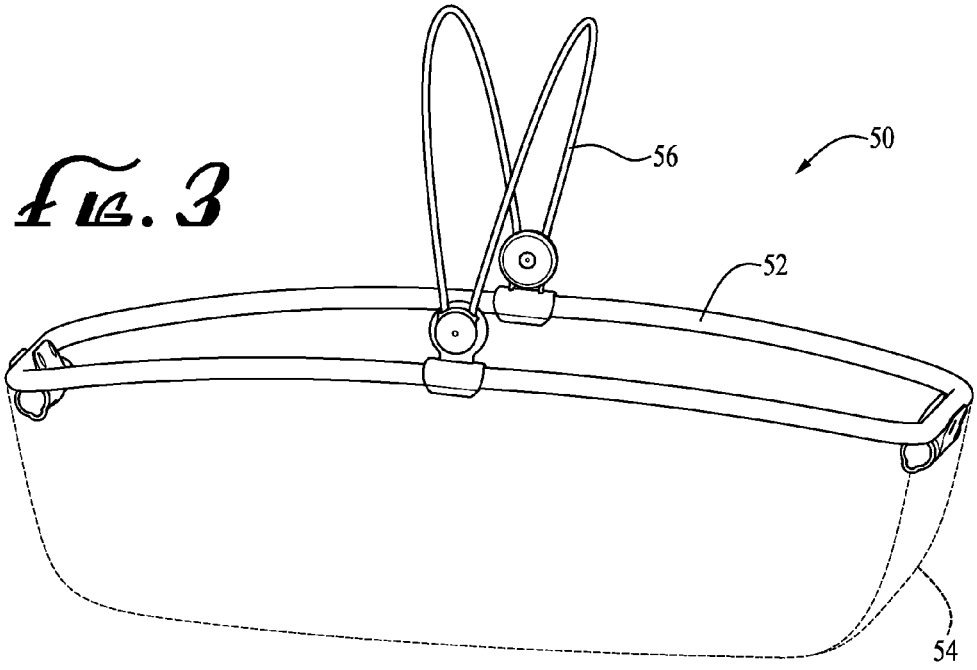
FIG. 3 is a perspective view of the first child support unit.
Figure 8:
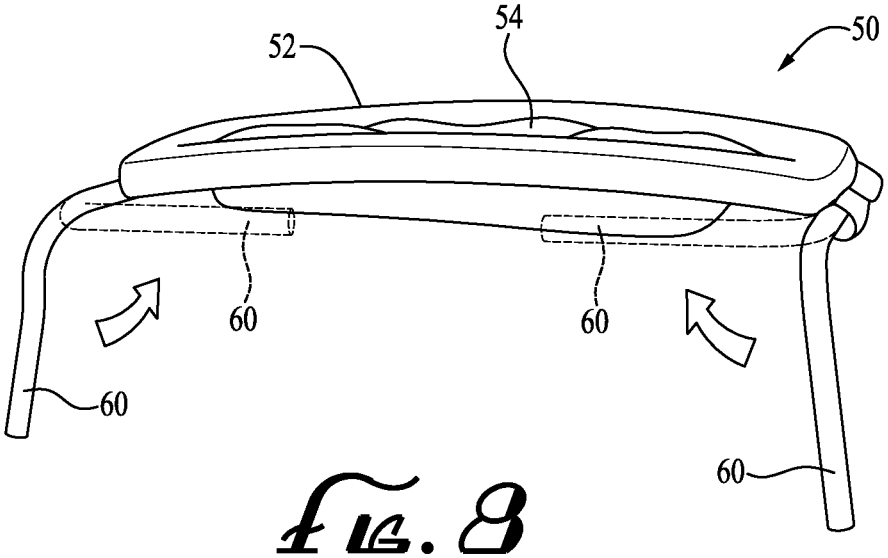

The first child support unit 50 is mounted to the play yard by at least one coupling, for example as shown in FIGS. 2 and 5. First and second mounting bars 60, each having a generally L-shaped configuration, have first ends for attachment to the frame of the play yard and second ends for attachment to the subframe of the first child support unit 50. For example, the first end of the mounting bar 60 is removably receivable within a corresponding mounting sleeve 30 attached to the frame of the play yard, and the second end of the mounting bar is receivable within a ferrule coupling attached to the subframe of the child support unit. As shown in FIG. 8, the mounting bars are optionally rotationally engaged within the ferrule couplings for compact storage when removed from the play yard frame. In alternate embodiments, various alternative coupling elements may be utilized for permanently or detachably mounting the child support unit to the play yard.

Optionally, the system 10 further comprises a second child support unit 70. For example, in the depicted embodiment, the second child support unit 70 comprises a changing table attachment having a generally rectangular subframe 72 to which a generally planar support panel may be mounted. One or more couplings 74 such as support struts with engagement clips secure the subframe of the second child support unit 70 to the frame of the play yard. One or more accessory trays or bins 80 are optionally mounted to the frame of the play yard, for holding toys, diapering supplies, a pacifier, or other items.

While the invention has been described with reference to preferred and example embodiments, it will be understood by those skilled in the art that a variety of modifications, additions and deletions are within the scope of the invention, as defined by the following claims.

What is claimed is:

1. A play yard system, comprising:

a play yard frame having upright frame members each having an upper end, a lower end, and an intermediate section between the upper and lower ends, at least one of the intermediate sections having a mounting sleeve affixed thereto in a generally vertical orientation; and a first child support unit comprising a support subframe comprising at least one support element configured for attachment to the intermediate section of at least one of the upright frame members of the play yard frame, wherein the at least one support element comprises a mounting bar having an end removably engagable within the vertically oriented mounting sleeve of the respective intermediate section of the respective upright frame member of the play yard frame.

2. The play yard system of claim 1, wherein the first child support unit comprises a bassinet.

3. The play yard system of claim 1, further comprising a second child support unit mountable to the play yard frame.

4. A child support unit for attachment to a play yard system, the child support unit comprising:

a subframe assembly and soft goods attached to the subframe assembly and defining a child support surface, wherein the subframe assembly comprises at least one support element configured for attachment to an upright frame member of the play yard system at an intermediate section of the upright frame member between an upper end and a lower end of the upright frame member so that the child support unit is positioned extending over an interior space of the play yard.

5. The child support unit of claim 4, wherein the subframe assembly comprises a generally rectangular structure comprising first and second side frame members and first and second end frame members, and wherein the at least one support element comprises a generally L-shaped bracket secured to at least one of the first and second end frame members.

6. The child support unit of claim 4, wherein the at least one support element comprises a mounting bar having an end removably engagable within a mounting sleeve affixed to the intermediate section of the upright frame member.

7. The child support unit of claim 4, comprising a bassinet.

8. The child support unit of claim 4, comprising a changing table.

9. A children's play yard apparatus, comprising:

a play yard frame having four corner posts, cross-members extending between the corner posts, sidewalls and a floor defining an interior space for receiving a child; and an external child support structure for removable attachment over the interior space of the play yard supported from the corner posts external of the interior space, wherein the corner posts each comprise a top end, a bottom end, and a middle section between the top and bottom ends, and wherein the external child support structure is removably attached to the middle section of at least one of the corner posts.

10. The children's play yard apparatus of claim 9, wherein the cross-members are hinged to allow folding of the play yard frame into a compact configuration and unfolding of the play yard frame into an expanded configuration.

11. The children's play yard apparatus of claim 9, wherein the external child support structure comprises a first child support structure, and wherein the play yard apparatus further comprises a second child support structure removably attached over the interior space alongside the first child support structure.

12. The children's play yard apparatus of claim 11, wherein the first child support structure is a bassinet and the second child support structure is a changing table.

13. The children's play yard apparatus of claim 9, wherein the external child support structure is a changing table.

14. The children's play yard apparatus of claim 9, wherein the external child support structure comprises a generally rectangular structure comprising first and second side frame members and first and second end frame members, and a pair of angled support brackets secured to at least one of the first and second end frame members.

15. The children's play yard apparatus of claim 9, wherein the external child support structure comprises pair support rods having ends removably engagable within mounting sleeves affixed to two of the corner posts.

16. The children's play yard apparatus of claim 9, wherein the external child support structure is a bassinet.

17. The children's play yard apparatus of claim 9, further comprising an accessory tray extending from one of the cross members.

* * * * *